US008772198B2

(12) United States Patent
Savagian

(10) Patent No.: US 8,772,198 B2
(45) Date of Patent: Jul. 8, 2014

(54) METHOD OF MAKING A SELF-EXPIRING IDENTIFICATION BADGE USING A THERMAL TRANSFER PRINTER

(75) Inventor: Michael D. Savagian, Germantown, WI (US)

(73) Assignee: Brady Worldwide, Inc., Milwaukee, WI (US)

( * ) Notice: Subject to any disclaimer, the term of this patent is extended or adjusted under 35 U.S.C. 154(b) by 14 days.

(21) Appl. No.: 13/557,405

(22) Filed: Jul. 25, 2012

(65) Prior Publication Data

US 2013/0027495 A1 Jan. 31, 2013

Related U.S. Application Data

(60) Provisional application No. 61/512,513, filed on Jul. 28, 2011.

(51) Int. Cl.

| | |
|---|---|
| ***B41M 5/323*** | (2006.01) |
| ***B41J 2/475*** | (2006.01) |
| ***B41M 5/327*** | (2006.01) |
| *G09F 3/02* | (2006.01) |

(52) U.S. Cl.

CPC ..... *B41M 5/323* (2013.01); *B41M 5/3275* (2013.01); *B41J 2/4753* (2013.01); *G09F 2003/0211* (2013.01)

USPC ..... 503/201; 40/5; 40/675; 503/221; 503/226

(58) Field of Classification Search

CPC ..... B41M 5/323; B41M 5/3275; B41M 5/42; B41J 2/4753; G09F 2003/0211

USPC ..... 503/200–226; 40/5, 675

See application file for complete search history.

(56) References Cited

U.S. PATENT DOCUMENTS

| | | | | |
|---|---|---|---|---|
| 4,903,254 | A | 2/1990 | Haas | |
| 5,661,101 | A * | 8/1997 | Washizu et al. | 503/226 |
| 6,544,925 | B1 | 4/2003 | Prusik et al. | |
| 7,215,604 | B2 | 5/2007 | Haas | |
| 7,434,535 | B2 | 10/2008 | Adamy | |
| 7,742,366 | B2 | 6/2010 | Haas | |

* cited by examiner

*Primary Examiner* — Bruce H Hess

(74) *Attorney, Agent, or Firm* — Whyte Hirschboeck Dudek S.C.

(57) ABSTRACT

Self-expiring labels and badges are made by a method of: (A) contacting a first component of a dye system with a second component of the dye system, the first component carried on a facial surface of a transfer ribbon and the second component carried on a facial surface of a media, the second component beneath and in contact with a timing layer, and (B) heating the contacted first component of the dye system and timing layer with a thermal print head such that (i) the first component of the dye system transfers to the timing layer, and (ii) the first component of the dye system begins to migrate through the timing layer to the second component of the dye system which, upon contact of the first and second components of the dye system, an image is formed.

15 Claims, 2 Drawing Sheets

Labelstock Cross Section

Ribbon Cross Section

Labelstock Cross Section

Printed/Activated Cross Section

METHOD OF MAKING A SELF-EXPIRING IDENTIFICATION BADGE USING A THERMAL TRANSFER PRINTER

BACKGROUND OF THE INVENTION

1. Field of the Invention

This invention relates to identification badges. In one aspect the invention relates to time-limited or temporary identification badges while in another aspect, the invention relates to self-expiring identification badges. In yet another aspect, the invention relates to a method of making a self-expiring identification badge.

2. Description of the Related Art

In the field of building security, the need for recognition of authorized personnel is significant. For employees and others who are regularly in secure areas, this is accomplished with identification (ID) badges, preferably photographic ID badges.

For workers and visitors to secure areas who are short term guests, the self-expiring badge is typically used. This type of badge typically comprises two components. One component is an opaque layer which may have additional text or graphics imprinted on it. The other component includes a dye on its surface. When the dye is attached (usually by hand lamination) to the back side of the opaque layer, it is solubilized by an adhesive or plasticizer and then migrates through the opaque layer over time and appears on the front surface. Its appearance indicates expiration. This type of badge is exemplified by the two piece TEMPBADGE, manufactured and sold by Brady Corporation. Other examples are found in many patents including U.S. Pat. No. 4,903,254.

Attempts at making this more convenient for the end user have centered on reducing the design to one piece with a number of elements contained in it. The components of the one piece are then rearranged by folding and/or removing protective liners to accomplish the lamination needed to activate the badge and initiate the timing process. See, for example, U.S. Pat. Nos. 7,742,366 and 7,215,604.

In the field of user printed badges, common and convenient methods include the use of direct thermal and thermal transfer printers. Direct thermal printers work with common media that employ dye chemistry for thermally imaging. This chemistry usually utilizes a leuco-dye along with a dye developer. The dye developer is typically an acid that is inactive at room temperature, but is activated by heat, sometimes by melting and sometimes by being solubilized by an accelerator that melts. The acid then reacts with the leuco-dye to form an image. Examples of this technology are very widespread and find common use as receipt paper in every day transactions. As it is so widespread, the printing technology and the chemistry are conveniently available. The image formation is nearly instantaneous when exposed to the heat supplied by the thermal printer.

Another approach to time expiration indication is the solubilization of an organic acid in a pressure-sensitive adhesive (PSA). This adhesive is coated on a clear film and supplied to the end-user as an over-laminate. In this case to activate the timing, the end-user must place the over-laminate on top of a direct thermal paper. The rate of migration of the organic acid from the adhesive determines the rate of image development and expiration indication (see, for example, U.S. Pat. No. 6,544,925). The requirement for end-user action in the initiation step, however, is still somewhat complicated.

Although a thermal transfer printer works using a similar heating process, the image is formed by the transfer of ink from a ribbon to a media. The ribbon comprises ink coated on a thin, heat resistant substrate (such as polyester film). Typically these are formulated using a pigment such as carbon black that is dispersed in a polymer binder. When heated, the binder will adhere to a substrate and transfer from the ribbon. Various binders as well as substrates and top coatings are employed for this purpose to achieve specialized performance.

All of these methods require active end-user participation which is both inconvenient and offers greater chance for defeating the timing mechanism (such as forgetting or refusing to activate the badge). As such there is an ongoing need for an improved method that will conveniently initiate a self-expiring badge on demand by the end-user.

SUMMARY OF THE INVENTION

In one embodiment the invention is a method of making a self-expiring label using a thermal transfer printer equipped with a transfer ribbon and a thermal print head, the method comprising the steps of:

A. Contacting a first component of a dye system with a second component of the dye system, the first component carried on a facial surface of the transfer ribbon and the second component carried on a facial surface of a media, the second component beneath and in contact with a timing layer, and B. Heating the contacted first component of the dye system and timing layer with the thermal print head such that (i) the first component of the dye system transfers to the timing layer, and (ii) the first component of the dye system begins to migrate through the timing layer to the second component of the dye system which, upon contact of the first and second components of the dye system, an image is formed.

In one embodiment the first component is a dye activator, developer and/or sensitizer (activator layer). In one embodiment the second component is a leuco dye (dye layer). In one embodiment the media is a badge or label. In one embodiment the invention is a badge or label made by the process.

The invention takes advantage of both thermal transfer printer technology as well as direct thermal imaging chemistry. One component of the dye system is an activator, e.g., a developer and/or sensitizer along with an appropriate binder polymer, and is coated onto or otherwise applied to the transfer ribbon. The other component of the dye system is the dye, e.g., a leuco dye along with an appropriate binder, which is coated onto or otherwise applied to the media. In one embodiment, the activator layer is coated onto the media and the dye layer is coated onto the transfer ribbon. Whichever component is coated onto the media, it is covered with a timing layer that acts as a permeable barrier through which the other component must pass so that an image can form immediately or gradually on the media upon contact of the two components with one another. Whichever component is coated onto the ribbon, this layer contains the sensitizer to enable permeability through the timing layer if that component is not migratory at room temperature (23° C.). Typically, the image forms gradually and becomes more intense over time as more and more of the component transferred from the transfer ribbon migrates through the timing layer and comes in contact with the component on the media. The compatibility of the migrating component with the timing layer and the thickness of the timing layer are the principal factors that determine the time for image development and thus expiration of the badge or label.

BRIEF DESCRIPTION OF THE DRAWINGS

The invention is described generally with reference to the drawings for the purpose of illustrating certain embodiments only, and not for the purpose of limiting the scope of the invention. In the drawings like numerals are used to designate like parts throughout the same.

DETAILED DESCRIPTION OF THE PREFERRED EMBODIMENT

Definitions

Figure 1:
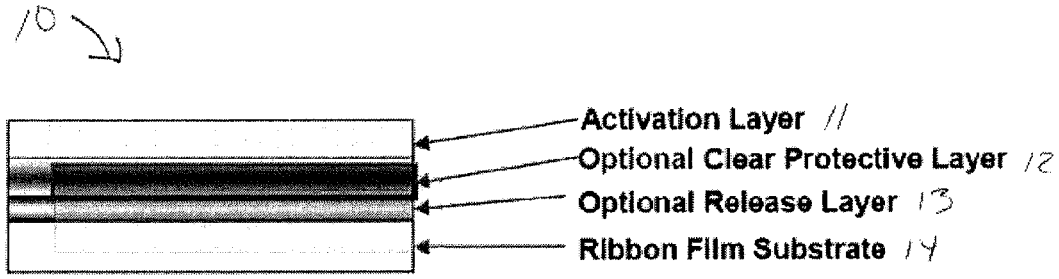
FIG. 1 is a cross-section drawing of one embodiment of a transfer ribbon.

Unless stated to the contrary, implicit from the context, or customary in the art, all parts and percents are based on weight and all test methods are current as of the filing date of this disclosure. For purposes of United States patent practice, the contents of any referenced patent, patent application or publication are incorporated by reference in their entirety (or its equivalent US version is so incorporated by reference) especially with respect to the disclosure of definitions (to the extent not inconsistent with any definitions specifically provided in this disclosure) and general knowledge in the art.

The numerical ranges in this disclosure are approximate, and thus may include values outside of the range unless otherwise indicated. Numerical ranges include all values from and including the lower and the upper values, in increments of one unit, provided that there is a separation of at least two units between any lower value and any higher value. As an example, if a compositional, physical or other property, such as, for example, layer thickness, etc., is from 100 to 1,000, then all individual values, such as 100, 101, 102, etc., and sub ranges, such as 100 to 144, 155 to 170, 197 to 200, etc., are expressly enumerated. For ranges containing values which are less than one or containing fractional numbers greater than one (e.g., 1.1, 1.5, etc.), one unit is considered to be 0.0001, 0.001, 0.01 or 0.1, as appropriate. For ranges containing single digit numbers less than ten (e.g., 1 to 5), one unit is typically considered to be 0.1. These are only examples of what is specifically intended, and all possible combinations of numerical values between the lowest value and the highest value enumerated, are to be considered to be expressly stated in this disclosure. Numerical ranges are provided within this disclosure for, among other things, the thickness of various layers, media and ribbons.

"Facial surface" and like terms are used in distinction to "edge surface". For example, if rectangular in shape or configuration, a layer, e.g., film, will comprise two opposing facial surfaces joined by four edge surfaces (two opposing pairs of edge surfaces, each pair intersecting the other pair at right angles). If circular in configuration, then the layer will comprise two opposing facial surfaces joined by one continuous edge surface.

"Permeable" and like terms describes a material, e.g., a film, coating, adhesive, etc., through which a fluid, i.e., a liquid or gas, can pass under normal use conditions. "Non-permeable" and like terms describes a material, e.g., a film, coating, etc., through which a fluid cannot pass under normal use conditions.

"Ink" and like terms mean a coatable or printable formulation that can and usually does contain a dye and/or pigment.

"Dye" and like terms mean a visible light absorbing compound that is present in a molecularly dispersed (dissolved) form.

"Dye precursor" and like terms mean a colorless leuco dye.

"Activator" and like terms mean a compound that converts a dye precursor to a colored leuco dye.

"Pigment" and like terms mean a visible light absorbing material or compound that is present in a non-molecularly dispersed (particulate) form.

"Sensitizer" and like terms mean a low melting, migratory compound that can solubilize either the developer and/or leuco dye to enhance the rate of color formation and to mobilize a non-migratory dye or developer through the timing layer.

"Image", "graphic", "graphic image" and like terms mean text or pictorial representations formed of ink or other dye or pigment substances. Images include, but are not limited to, words, numbers, bar codes, pictures, designs (geometric or otherwise), and solid colors.

"Thermal transfer printer" and like terms mean a printer which prints on media, e.g., paper, plastic, etc., by melting a coating of ribbon so that it adheres to the material to which the print is applied. It contrasts with direct thermal printing in which no ribbon is used.

"Transfer ribbon", "ribbon" and like terms mean a film or like material that has been coated on the printing facial surface with a binder, e.g., wax or wax resin, that will melt under the heat of a thermal print head and transfer to the print surface of a media.

"Leuco dye" and like terms mean a dye whose molecules can acquire two forms, one of which is colorless and the other of which is colored.

"Carried on" and like terms mean that one layer of a laminate is above another layer within the laminate. The top or above layer may or may not be in direct contact with the bottom or carrying layer, i.e., one or more intermediate layers may separate the top and bottom layers. For example, the film substrate layer of a transfer ribbon carries the activation layer, and the activation and film substrate layers may be in direct contact with one another, e.g., the activation layer is laminated, printed or coated directly to the film substrate so that each is in direct contact with one another, or the two layers may be separated by one or more of a protective layer and/or release layer. Likewise, the substrate layer of a label carries the timing layer although the two layers are separated by a dye imaging layer.

Although the invention is further described in the context of making self-expiring badges, the invention is applicable to making other self-expiring items such as, but not limited to, labels and tags.

Method

FIG. 1 is a cross-section of one embodiment of a transfer ribbon. Ribbon 10 comprises activation layer 11 which is over and in direct contact with optional clear protective layer 12, which is over and in direct contact with optional release layer 13 which is over and in direct contact with film substrate 14. If optional clear protective layer 12 is absent, then activation layer 11 is over and in direct contact with optional release layer 13 and if optional release layer 13 is also absent, then activation layer 11 is over and in direct contact with film substrate 14.

In one embodiment the activation layer includes an acidic dye developer which can take the form of a migratory liquid. Examples include any liquid organic acid such as oleic acid or, more preferably, a solid organic acid commonly used in the production of thermo-sensitive recording paper such as bisphenol A (2,2-bis(4-hydroxyphenyl)propane or benzyl-4-hydroxybenzoate. If a solid, non-migratory acid is used, then a sensitizer is also used to transport the acid through the timing layer to the dye layer. In this instance a plasticizer which is compatible with and can solubilize the organic acid and carry it through the timing layer is also used. The selection of the plasticizer is dependent, at least in part, upon the composition of the binding polymer and timing layer, and it can include high boiling solvents and plasticizers such as isophorone and hexylene glycol.

Binding polymers include, but are not limited to, polyvinyl alcohol, ethylene vinyl acetate, polyvinyl chloride, urethanes, polyesters, acrylates and the like as long as they are sufficiently thermoplastic to act as a medium for thermal transfer. The art of thermal transfer ribbons is replete with examples of polymer binders that can be used in the practice of this invention. Sufficient compatibility to hold the activator and sensitizer are additional considerations in the selection of a binding polymer for use in this invention. In one embodiment, the activation layer typically has a thickness of 0.2 to 10 microns (μm), preferably a thickness of 0.5 to 5 μm.

Protective layers are typically comprised of clear (unpigmented) polymers formulated for good release from the release or substrate layers. These offer some degree of protection from abrasion. Acrylic, polyester and urethane polymers can offer this type of protection. The protective layer thickness is typically of 0.1 to 3 μm, more typically of 0.2 to 2 μm.

Release layers are commonly crosslinked silicones and are found on standard release liners. The release layer is typically used only if sufficient release from the substrate layer is not attainable from the chosen activation layer or protective layer formulation. The thickness of the release layer is typically 0.1 to 2 μm.

Substrates commonly used in the practice of this invention include polyester and polypropylene films. These are selected to gain sufficient heat resistance when the ribbon is exposed to the heat of a thermal transfer process. Typical thickness of the substrate layer is 5 to 20 μm, more typically 8 to 12 μm.

Figure 2:
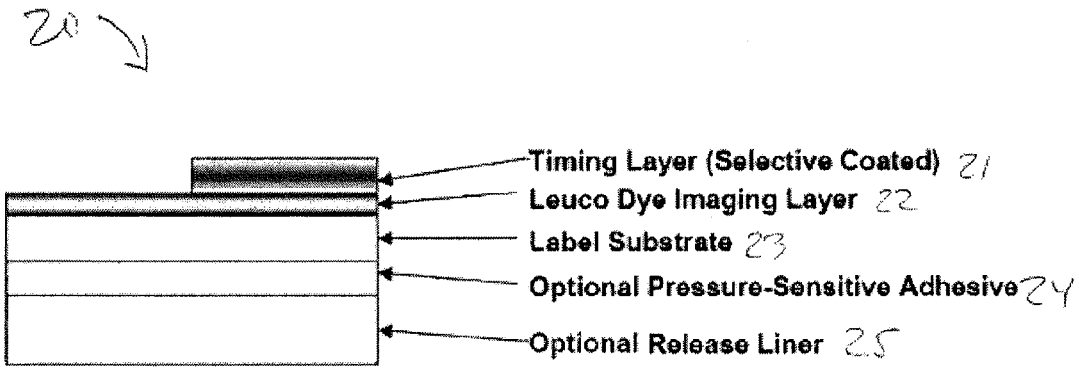
FIG. 2 is a cross-section drawing of one embodiment of a media or label stock.

FIG. 2 is a cross-section of one embodiment of a label stock (one form of media). Label stock 20 comprises timing layer 21 which is over and in direct contact with dye imaging layer 22, which is over and in direct contact with label substrate 23 which is over and in direct contact with optional PSA 24, which is over and in direct contact with optional release liner 25. If optional PSA 24 is absent, then label substrate 23 is over and in direct contact with optional release layer 25 and if optional release layer 25 is also absent, then label substrate layer is the bottom layer of the label stock.

The timing layer is formulated from polymer binders that can be selectively coated to supply a temporary barrier to the organic acid or acid solubilized by the sensitizer. The formulation is preferably based on a polymer similar to the polymer binder of the activation layer to give sufficient compatibility to the organic acid or sensitizer plus organic acid. Polyvinyl alcohol is a good choice for the timing layer if a polar sensitizer is used. The rate of permeation through the timing layer (thus the timing of activation) is controlled by selection/manipulation of such properties as molecular weight, crosslink density, present or absence of fillers or other blended polymer (and if present, the amount), and thickness. The polyvinyl alcohol can be crosslinked through the use of, for example, an isocyanate or UV radiation in combination with a photo-initiator. Other possible materials for use as the timing layer include acrylates, polyvinyl chloride, polyurethane, polyesters and the like. The timing layer thickness typically is of 2 to 30 μm, more typically of 4 to 15 μm.

The leuco dye imaging layer typically includes the leuco dye and a polymer binder, and it is typically continuous, i.e., it typically covers the entire facial surface of the film substrate to which it is applied. Leuco dyes include the fluoran compounds commonly used in the manufacture of thermo-sensitive recording media. Examples include, but are not limited to, 2'-anilino-6'-di-n-butylamino-3'-methylfluoran and 2'-anilino-6'(N-ethyl-N-isopentylamino)-3'-methyl-fluoran. These can again be part of a polymer binder matrix of polyvinyl alcohol, but acrylates, polyvinyl chloride, polyurethane, polyesters and the like can also be used. High concentrations of leuco dye will enable the use of a thin coating and enable faster image formation once contacting and reacting with the acid from the activation layer begins. The leuco dye concentration can range from 3 to 90 percent of the total solids, more typically from 20 to 60% of the total solids. Thickness of this layer is typically of 2 to 20 μm, more typically of 4 to 10 μm.

Figure 3:
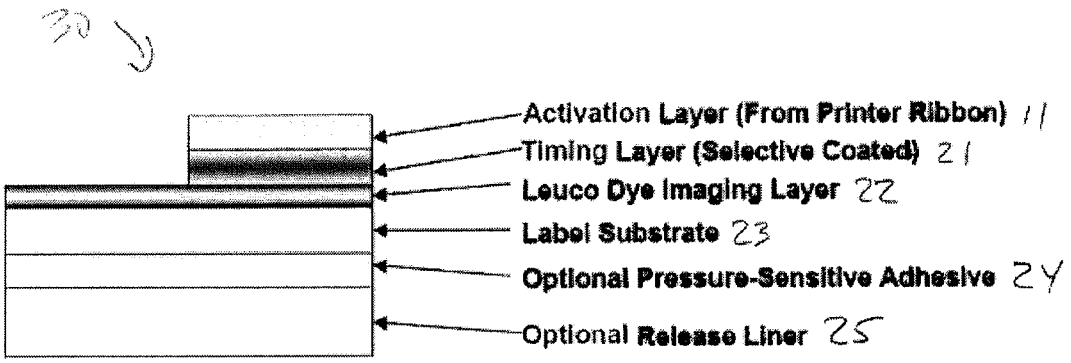
FIG. 3 is a cross-section drawing of the media or label stock of FIG. 2 that has been printed using the transfer ribbon of FIG. 1.

FIG. 3 is a cross-section drawing of the label stock of FIG. 2 that has been printed using the transfer ribbon of FIG. 1. In this Figure, activated label stock 30 comprises label stock 20 carrying some or all of activation layer 11 which has been transferred to the top or open facial surface of timing layer 21.

The activator can be applied to the optional clear protective layer or optional release layer or film substrate by any conventional technique, e.g., printing, flood coating, lamination, etc., and if present, the optional clear protective layer and the optional release layer can be applied to their respective adjacent layers using one or more of the same techniques. The activator layer is typically continuous, i.e., it typically covers the entire facial surface of the optional clear protective layer or optional release layer or film substrate to which it is applied.

Likewise, the timing layer can be applied by any conventional techniques although printing (including flexographic, gravure and screen printing) is a typical and preferred technique. Preferably it is applied along one or two edges of label stock 20, but could be anywhere on the label stock. Additionally it can be in the shape of text or a graphic element, however block form is sufficient as the printer which activates it could do this in the shape of text or a graphic element. The area remaining open on each label stock is available for printing the text and graphics that are typically provided. Where there is not a timing layer, image development is immediate.

In practice, the self-expiring badge is prepared using conventional thermal transfer printing methods. The printer is equipped with a ribbon, usually spooled onto a reel and fed through the printer over a driven rubber roller (the platen). The ribbon is fed in sync with the label stock that usually has individual labels carried on a continuous carrier strip. The ribbon and label are brought into contact with one another beneath and in contact with the thermal print head which imparts sufficient heat and force to transfer all or part of the activator to the timing layer. Once on the timing layer, the activator begins, either immediately or after a delay, to migrate through the timing layer towards the dye layer beneath it. Upon contact with the dye, the activator begins to convert the dye into a desired image.

Any imaging chemistry can be utilized by incorporating one component in the transfer ribbon and the other on the media. An example of an alternative chemistry for indication is illustrated in U.S. Pat. No. 7,434,535 which takes advantage of an oxidation-reduction reaction. The only limitation is that the activation layer component (on the ribbon initially) is sufficiently compatible with the timing layer to migrate through it at the desired rate.

Although the invention has been described with certain detail through the preceding description of the preferred embodiments, this detail is for the primary purpose of illustration. Many variations and modifications can be made by one skilled in the art without departing from the spirit and scope of the invention as described in the following claims.

What is claimed is:

1. A method of making a self-expiring label or badge using a thermal transfer printer equipped with a transfer ribbon and a thermal print head, the method comprising the steps of:

A. Contacting a first component of a dye system with a second component of the dye system, the first component carried on a facial surface of the transfer ribbon and the second component carried on a facial surface of a media, the second component beneath and in contact with a timing layer, and B. Heating the contacted first component of the dye system and timing layer with the thermal print head such that (i) the first component of the dye system transfers to the timing layer, and (ii) the first component of the dye system begins to migrate through the timing layer to the second component of the dye system which, upon contact of the first and second components of the dye system, an image is formed.

2. The method of claim 1 in which the second component of the dye system is a leuco dye.

3. The method of claim 2 in which the first component of the dye system is an activator.

4. The method of claim 3 in which the activator is an organic acid.

5. The method of claim 4 in which the media comprises the timing layer over and in direct contact with a dye imaging layer, and the dye imaging layer is over and in direct contact with a label substrate, and the label substrate is over and in direct contact with an optional PSA, and the optional PSA is over and in direct contact with an optional release liner.

6. The method of claim 3 in which the media comprises the timing layer over and in direct contact with a dye imaging layer, and the dye imaging layer is over and in direct contact with a label substrate, and the label substrate is over and in direct contact with an optional PSA, and the optional PSA is over and in direct contact with an optional release liner.

7. The method of claim 3 in which the transfer ribbon comprises the first component as an activation layer which is over and in direct contact with an optional clear protective layer, the clear protective layer over and in direct contact with an optional release layer, and the optional release layer over and in direct contact with a film substrate.

8. The method of claim 2 in which the leuco dye comprises at least one of 2'-anilino-6'-di-n-butylamino-3'-methylfluoran and 2'-anilino-6'(N-ethyl-N-isopentylamino)-3'-methylfluoran.

9. The method of claim 2 in which the media comprises the timing layer over and in direct contact with a dye imaging layer, and the dye imaging layer is over and in direct contact with a label substrate, and the label substrate is over and in direct contact with an optional PSA, and the optional PSA is over and in direct contact with an optional release liner.

10. The method of claim 2 in which the transfer ribbon comprises the first component as an activation layer which is over and in direct contact with an optional clear protective layer, the clear protective layer over and in direct contact with an optional release layer, and the optional release layer over and in direct contact with a film substrate.

11. The method of claim 1 in which the first component of the dye system is an activator.

12. The method of claim 11 in which the media comprises the timing layer over and in direct contact with a dye imaging layer, and the dye imaging layer is over and in direct contact with a label substrate, and the label substrate is over and in direct contact with an optional PSA, and the optional PSA is over and in direct contact with an optional release liner.

13. The method of claim 11 in which the transfer ribbon comprises the first component as an activation layer which is over and in direct contact with an optional clear protective layer, the clear protective layer over and in direct contact with an optional release layer, and the optional release layer over and in direct contact with a film substrate.

14. The method of claim 1 in which the media comprises the timing layer over and in direct contact with said second component in a dye imaging layer, and the dye imaging layer is over and in direct contact with a label substrate, and the label substrate is over and in direct contact with an optional PSA, and the optional PSA is over and in direct contact with an optional release liner.

15. The method of claim 1 in which the transfer ribbon comprises the first component as an activation layer which is over and in direct contact with an optional clear protective layer, the clear protective layer over and in direct contact with an optional release layer, and the optional release layer over and in direct contact with a film substrate.

* * * * *